United States Patent [19]

Abe

[11] Patent Number: 5,009,983

[45] Date of Patent: Apr. 23, 1991

[54] METHOD FOR PROCESSING SILVER HALIDE PHOTOSENSITIVE MATERIALS

[75] Inventor: Akira Abe, Kanagawa, Japan

[73] Assignee: Fuji Photo Film Co., Ltd., Kanagawa, Japan

[21] Appl. No.: 551,822

[22] Filed: Jul. 12, 1990

[30] Foreign Application Priority Data

Jul. 14, 1989 [JP] Japan ..... 1-180591

[51] Int. Cl.[5] ..... G03C 7/40

[52] U.S. Cl. ..... 430/372; 430/393; 430/400; 430/421; 430/428; 430/463

[58] Field of Search ..... 430/372, 393, 400, 421, 430/428, 463

[56] References Cited

U.S. PATENT DOCUMENTS 4,451,132 5/1984 Kishimoto ..... 430/398

FOREIGN PATENT DOCUMENTS 0248450 12/1987 European Pat. Off. .

OTHER PUBLICATIONS

Abstract of JPA-58-105150, 06/83.
Abstract of JPA-096352, 05/84.
Abstract of JPA-61-028949, 02/86.
Abstract of JPA-131632, 06/86.
Abstract of JPA-62-288838, 12/87.
Abstract of JPA-62-254151, 11/87.
Abstract of JPA-60-241053, 11/85.
Abstract of DE 3246897, 06/83.
Patent Abstracts of Japan, vol. 11, No. 109 (P-564) (2556), Apr. 7, 1987, for JP-A-61 258245 (Konishiroku Photo Industry Co., Ltd.) Nov. 15, 1986.
Database WPIL, No. 83-762632, Derwent Publications Ltd., London, GB for JP-A-58133885 (Toray Eng. KK) Sep. 8, 1983.

*Primary Examiner*—Hoa Van Le
*Attorney, Agent, or Firm*—Sughrue, Mion, Zinn, Macpeak & Seas

[57] ABSTRACT

A method for processing silver halide photosensitive materials is described which includes processing an imagewise-exposed silver halide photosensitive material in a bath which has a fixing ability and then at least one of washing and stabilizing the photosensitive materials in a multi-stage counter-flow system, wherein liquid from at least one of a water washing tank and a stabilizing tank is treated using a reverse osmosis membrane and the treated liquid is recycled to at least one of the water washing tank and the stabilizing tank, and at least a tank at the stage at which the liquid is removed for the reverse osmosis membrane treatment has an open fraction of not more than 0.03.

20 Claims, 1 Drawing Sheet

FIGURE
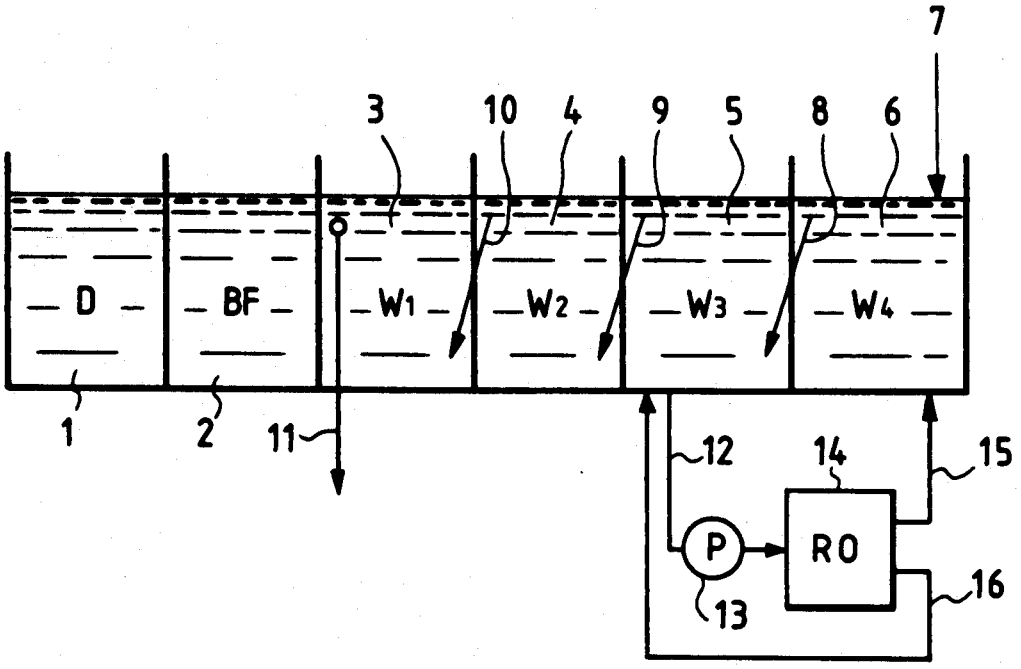

METHOD FOR PROCESSING SILVER HALIDE PHOTOSENSITIVE MATERIALS

FIELD OF THE INVENTION

This present invention concerns a method for processing silver halide photosensitive materials, and in particular it concerns a method for processing silver halide photosensitive materials in which the water and/or liquid used in the water washing and/or stabilizing process is reused by means of an efficient reverse osmosis membrane treatment.

BACKGROUND OF THE INVENTION

Silver halide photosensitive materials are processed by development, fixing and water washing, for example, after being subjected to an imagewise exposure.

In recent years, a demand has arisen for minimizing the hazardous components in effluent streams and reducing the amount of effluent, or providing a system with no effluent. In particular, from the viewpoints of environmental protection and conservation of resources, a demand has arisen for a reduction in the amount of washing water. Various studies have been conducted in response to these demands.

As a result, in JP-A-58-105150 (the term "JP-A" as used herein signifies an "unexamined published Japanese patent application") a photographic processing apparatus is disclosed in which the washing water is reused with the aid of a reverse osmotic pressure device. Photographic processing apparatus is furnished with a reverse osmotic pressure device in which the liquid intake, the concentrate side outlet and the diluted side output are connected to the water washing tank, the bleach-fixing tank and the water washing tank, respectively. The washing water expelled from the water washing tank is treated by means of the reverse osmotic pressure device, and the concentrate which is produced is returned to the bleach-fixing tank while the dilute liquid is returned to the water washing tank.

Furthermore, JP-A-60-241053 proposes a method of processing in which silver halide color photosensitive materials are color developed, processed in a processing bath which has a fixing capacity and then subjected to a stabilizing process substantially without water washing wherein the stabilizer liquid is treated by means of a reverse osmosis membrane. With this method of processing, the production of yellow staining on long term storage and the development of staining immediately after processing are said to be prevented.

Moreover, for reducing the replenishment rate of the washing water, JP-A-62-254151 proposes a method of processing silver halide color photosensitive materials in which, when water washing and/or stabilization is carried out using a multi-stage counter-flow system after treating a silver halide color photosensitive material in a bath which has a fixing ability, the overflow from the water washing tank, and/or stabilizing tank is introduced into a storage tank and the liquid in the storage tank is treated with a reverse osmosis membrane. The liquid permeating through the reverse osmosis membrane is returned to the water washing tank and/or the stabilizing tank, and the concentrated liquid is returned to the storage tank in order to reduce the amount of concentrated liquid which is expelled from the reverse osmosis membrane treatment apparatus.

The reverse osmosis membrane treatment of washing water and stabilizing liquid is very useful for economizing on washing water and stabilizer liquid, but the main problem with this method is that the amount of liquid permeated is reduced by blockage of the membrane. Although the efficiency is initially high with reverse osmosis membrane treatment, the membrane will inevitably become blocked in a short period of time.

As a result of analyzing this problem, it has been discovered that blockage of the fine pores of the membrane results from the attachment of trace quantities of silver sulfide which are produced in the washing water or stabilizing liquid and of colonies of bacteria to the membrane surface.

This phenomenon is especially pronounced when the rate of replenishment of the bath which has a fixing ability is reduced, the silver concentration in the bath which has a fixing ability is increased and the amount of silver which is introduced into the water washing tank or stabilizing tank is increased with an increase in the amount of silver sulfide formed in the washing water or stabilizing liquid. When the replenishment rate of the washing water or stabilizing liquid is reduced, the residence time of the washing water or stabilizing liquid in the tank is increased, promoting an increase in the amount of silver sulfide which is produced. Moreover, it has also been confirmed that in those cases where the color development bath contains benzyl alcohol, the benzyl alcohol is carried over into the washing water or stabilizing bath, where it promotes the growth of bacteria and increases the amount of material which is attached to the membrane.

SUMMARY OF THE INVENTION

The present invention is intended to ensure that when, during the processing of silver halide photosensitive materials, the washing water and/or stabilizing liquid is treated by means of a reverse osmosis membrane, there is no reduction in the amount of permeation due to blockage of the membrane, or the reduction is suppressed to the lowest possible limit.

As a result of their investigation of various devices for resolving the problems described above, the inventors have discovered that the production of silver sulfide and the growth of bacteria, which are the causes of membrane blockage, can be prevented by reducing the oxygen supply to the washing water or stabilizing liquid. Contact between the washing water or stabilizing liquid with the air should be minimized in order to reduce the oxygen supply. Therefore, the open fraction of the processing tank, which is defined by S/V (where S is the area of contact with the air ($cm^2$) and V is the liquid volume of the washing water or stabilizing liquid ($cm^3$)), should be minimized.

Specifically, the present invention is a method for processing imagewise-exposed silver halide photosensitive materials which includes processing an silver halide photosensitive material in a bath which has a fixing ability and them at least one of washing and stabilizing the photosensitive material in a multi-stage counter-flow system, wherein liquid from at least one of a water washing tank and a stabilizing tank is treated using a reverse osmosis membrane and the treated liquid is recycled to at least one of the water washing tank and the stabilizing tank, and at least a tank at the stage at which the liquid is removed for the reverse osmosis membrane treatment has an open fraction of not more than 0.03.

BRIEF DESCRIPTION OF THE DRAWING

The drawing is a diagram of a processing apparatus which has a four stage counter-flow water washing system as used in Example 1 described below, wherein:

1 is a color development tank (D);
2 is a bleach-fixing tank (BF);
3 is a first water washing tank ($W_1$);
4 is a second water washing tank ($W_2$);
5 is a third water washing tank ($W_3$);
6 is a fourth water washing tank ($W_4$);
7 is washing water;
8 is a connecting pipe from $W_4$ to $W_3$;
9 is a connecting pipe from $W_3$ to $W_2$;
10 is a connecting pipe from $W_2$ to $W_1$;
11 is an overflow stream;
12 is washing water for treatment;
13 is a pump;
14 is a reverse osmosis membrane module;
15 is permeated water; and
16 is concentrate

DETAILED DESCRIPTION OF THE INVENTION

In many multi-stage counter-flow systems in which a plurality of water washing tanks or stabilizing tanks are present, water or stabilizing liquid is supplied to the tank in which the final washing or stabilization is carried out and the water or stabilizing liquid in this tank is fed to the tank of the previous stage where a similar procedure is followed. This scheme is commonly used in order to reduce the amount of washing water or stabilizing liquid for water washing or stabilization in the processing of silver halide photosensitive materials.

A reverse osmosis membrane treatment is then used in order to purify the washing water or stabilizing liquid which is used in the washing and/or stabilizing process. Cellulose acetate membranes, ethylcellulose-poly(acrylic acid) membranes, polyacrylonitrile membranes and poly(vinylene carbonate) membranes, for example, can be used for the reverse osmosis membrane in the reverse osmosis membrane treatment.

Reverse osmosis membranes which have a spiral form, a tubular form, a hollow fiber form, a pleated form or a rod-like form can be used.

Preferably, the washing water or stabilizing liquid for reverse osmosis membrane treatment is removed from the third tank in a case where four washing tanks or stabilization tanks are present, and the permeated water which has been subjected to reverse osmosis and refined is supplied to the fourth stage to which fresh water or liquid is being supplied. Washing water or stabilizing liquid can also be removed from any of the other water washing tanks or stabilizing tanks, or from two or more of the tanks.

In the present invention, the open fraction of the tanks used for the water washing and/or stabilizing tanks is not more than 0.03, and at least the tank from which the water or liquid is removed for the reverse osmosis membrane treatment has an open fraction of not more than 0.03.

A smaller open fraction for the tank is preferred, but the water washing tank or stabilizing tank cannot be closed completely to the air in view of the fact that the silver halide photosensitive material must pass through the system. In practice, the open fraction of the tank is not more than 0.03, preferably not more than 0.02, and most desirably not more than 0.01. The lower limit for the open fraction is of the order of 0.002.

Methods in which the surface is covered with a floating lid, for example, are useful as a means of establishing the open fraction of a tank at not more than 0.03. Furthermore, methods in which floating lids which are fitted to the racks or tanks, methods in which a water insoluble high boiling point liquid which has a specific gravity of less than 1 (for example, liquid paraffin) is floated over the liquid surface, and methods in which tanks which are used have an opening such that the liquid surface is constricted, for example, can also be employed.

When the open fraction is reduced in this way, the amount of liquid permeating the membrane in the reverse osmosis membrane treatment is increased. This increase is due to a reduction in the formation of silver sulfide. Surprisingly, though, the water quality of the permeated liquid is not always good, and there are some cases in which there is no reduction in bacterial count. An investigation into the cause of this problem has shown that problems such as a worsening of the water quality of the permeated liquid arise when benzyl alcohol is included in the color development bath. The relationship between the amount of water permeating the membrane in the reverse osmosis membrane treatment and the quality of the permeated water with the presence or absence of benzyl alcohol and the open fraction of the water washing tank is shown below in Table 1.

TABLE 1

| Benzyl Alcohol | Opening | Amount of Permeated Water | Water Quality |
|---|---|---|---|
| Yes | Wide | Small | Good |
| Yes | Narrow | Large | Poor |
| No | Wide | Small | Good |
| No | Narrow | Large | Good |

When benzyl alcohol is included in the color development bath, it is carried over into the water washing tank as the photosensitive material is being processed, resulting in the proliferation of bacteria and the worsening of the quality of the permeated water from the reverse osmosis even when the opening is small. Furthermore, when bacteria proliferates as a result of the presence of benzyl alcohol, the reverse osmosis membrane which is being used for the reverse osmosis membrane treatment becomes impregnated with bacteria, its cell structure is destroyed and its efficiency decreases.

Hence, in connection with the present invention, the use of color developers which do not contain benzyl alcohol for color development and the setting of the open fraction of the water washing and/or stabilizing tank at not more than 0.03 for the processing of silver halide photosensitive materials is very effective.

Various compounds may be added to the washing water or stabilizing liquid in the present invention. For example, film hardening agents as typified by magnesium salts and aluminum salts, surfactants for reducing the drying load and preventing unevenness, fluorescent whiteners for increasing whiteness and sulfites as preservatives may be included. Alternatively, the compounds disclosed, for example, L. E. West, "Water Quality Criteria", *Photo. Sci. and Eng.*, Volume 9, No. 6 (1965) may be added.

In the present invention, a stabilizing liquid is a liquid which has an image stabilizing function which cannot be achieved with water washing. This liquid contains components which fulfill an image stabilizing role in addition to the aforementioned components which can be added to the washing water, and it is known as a "stabilizer".

For example, it may be a liquid to which formalin, bismuth salts, and aqueous ammonia or ammonium salts, for example, have been added.

In the process of the present invention, the process can be advantageouly carried out when the amount of the replenisher is not more than 200 ml/m$^2$ of photosensitive material, with more preferably from 160 ml to 50 ml/m$^2$.

The pH of the washing water or stabilizing liquid in the present invention is generally about 7, but it may be, generally, within the range from 3 to 9, depending on the carry-over from the previous bath. The water washing or stabilization temperature is generally from 5° C. to 40° C., and preferably from 10° C. to 35° C. Heaters, temperature controllers, circulating pumps, filters, floating lids and squeegees, etc. may be used in the water washing tanks or stabilizing tanks.

The photographic processing of the photosensitive material in this invention may be processing in which a silver image is formed (black-and-white processing) or it may involve a development process in which a color image is formed (color development processing). In those cases where an image is formed using a reversal procedure, a black-and-white negative development process is carried out first, followed by a white light exposure, or treatment in a bath which contains a fogging agent, and a color development process.

Black-and-white development processing consists of a development process, a fixing process and a water washing process. A stop process is sometimes carried out after the development process, and in cases where a stabilizing process is carried out after the fixing process, the water washing process can be omitted. Development processes in which lith developers are used for the developer can also be used.

The black-and-white developers generally used for the processing of black-and-white photosensitive materials can be used for the black-and-white developer which is used for the black-and-white processing operation, and the various additives which are generally added to a black-and-white developer can be included.

Typical additives include developing agents such as 1-phenyl-3-pyrazolidone, metol and hydroquinone, preservatives such as sulfites, accelerators composed of alkalis such as sodium hydroxide, sodium carbonate and potassium carbonate, inorganic or organic restrainers such as potassium bromide or 2-methylbenzimidazole and methylbenzthiazole, water softening agents such as polyphosphoric acid, and surface super-development inhibitors such as trace quantities of iodide or mercapto compounds.

Color development processing is carried out with a color development process, a bleaching process, a fixing process, a water washing process and, where required, a stabilizing process, but a bleach-fixing process with a single bleach-fixing bath can be used instead of processing with a process in which a bleach bath is used and a process in which a fixing bath is used. Mono-bath processing, in which a single developing bleaching and fixing bath is used for color development, bleaching and fixing, can also be used.

Pre-film hardening processes, neutralizing processes, stop-fix processes and post-film hardening processes, for example, can be combined with these processes.

Typical color development processing procedures for the present invention are indicated below, but processing is not limited to the examples shown.

A. Color developing—bleach-fixing—water washing—drying
B. Color developing—bleach-fixing—water washing—stabilizing—drying
C. Color developing—water washing—bleach-fixing—water washing—drying
D. Color developing—bleaching—fixing—water washing—stabilizing—drying
E. Color developing—bleaching—fixing—water washing—drying
F. Color developing—water washing—bleaching—fixing—water washing—drying
G. Color developing—bleaching—bleach-fixing—water washing—stabilizing—drying
H. Color developing—bleaching—bleach-fixing—water washing—drying
I. Color developing—bleaching—bleach-fixing—fixing—water washing—stabilizing—drying
J. Color developing—bleaching—bleach-fixing—fixing—water washing—drying In the above examples where the process prior to the stabilizing process is a water washing process, the water washing process can be omitted and the stabilizing process can be carried out directly.

Among the process illustrated above, the processes A and B, and the process B excluding "water-washing" step prior to "stabilizing" are preferable.

The color development baths which can be used in the present invention are aqueous alkaline solutions which contain a primary aromatic amine based color developing agent. Aminophenol based compounds are also useful, but the use of p-phenylenediamine derivatives is preferred. Typical examples include 3-methyl-4-amino-N,N-diethylaniline, 3-methyl-4-amino-N-β-hydroxyethylaniline, 3-methyl-4-amino-N-ethyl-N-β-methanesulfonamidoethylaniline, 3-methyl-4-amino-N-ethyl-N-β-methoxyethylaniline and the sulfates, hydrochlorides and p-toluenesulfonates thereof. Two or more of these compounds can be used jointly according to the intended purpose.

Various preservatives can be used in the color development bath. It is desirable that the competitive reactivity with respect to the coupling reaction between the oxidized form of the color developer and the couplers be low and that the development activity with respect to silver halide be low in order to make up for the loss of color formation which arises as a result of the omission of benzyl alcohol.

From this viewpoint, it is desirable that sulfite and hydroxylamines, which have been widely used in the past, be suppressed to as low a level as possible, and preferably not used at all.

The use of hydroxylamine derivatives such as alkyl substituted hydroxylamine, hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamido compounds or condensed amines, for example, instead of sulfites and hydroxylamine is preferred.

Such compounds have been disclosed, for example, in JP-A-63-4235, JP-A-63-30845, JP-A-63-21647, JP-A-63-

44655, JP-A-63-53551, JP-A-63-43140, JP-A-63-56654, JP-A-63-58346, JP-A-63-43138, European Laid Open Patent 254,280, JP-A-63-44657, JP-A-63-44656, U.S. Pat. No. 3,615,530 and 2,494,903, JP-A-52-143020 and JP-B-48-30496. (The term "JP-B" as used herein signifies an "examined Japanese patent publication".)

The above mentioned preservatives are preferably added to the color development bath at concentrations of from 0.005 to 0.5 mol/liter, and most desirably at concentrations of from 0.03 to 0.1 mol/liter.

The color development bath used in the present invention preferably has a pH of from 9 to 11, and most desirably has a pH of from 9.5 to 10.5.

Developer components other than those disclosed above can also be included in the color development bath.

The use of various buffers is desirable for maintaining the pH values indicated above. Examples of buffers include sodium carbonate, potassium carbonate, sodium bicarbonate, potassium bicarbonate, tri-sodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The buffers are preferably added to the color development bath at a concentration of at least 0.1 mol/liter, and most desirably at a concentration of from 0.1 to 0.4 mol/liter.

Various chelating agents can also be used in the color development bath as agents for preventing the precipitation of calcium and magnesium or for increasing the stability of the color developing agent.

Examples of chelating agents are indicated below, but the chelating agents are not limited by these examples.

Nitrilo triacetic acid
Diethylenetriamine penta-acetic acid
Ethylenediamine tetra-acetic acid
Triethylenetetramine hexa-acetic acid
N,N,N-Trimethylenephosphonic acid
Ethylenediamine-N,N,N',N'-tetramethylenephosphonic acid
1,3-Diamino-2-propanol tetra-acetic acid
Trans-cylcohexanediamine tetra-acetic acid
Nitrilo tripropionic acid
1,2-Diaminopropane tetra-acetic acid
Hydroxyethylimino diacetic acid
Glycol ether diamine triacetic acid
Hydroxyethylenediamine triacetic acid
Ethylenediamine o-hydroxyphenylacetic acid
2-Sulfonobutane-1,2,4-tricarboxylic acid
1-Hydroxyethylidene-1,1-disulfonic acid
N,N,-bis(2-hydroxybenzyl)ethylenediamine-N,N'-diacetic acid Two or more of these chelating agents can be used jointly where required.

The amount of these chelating agents added should be sufficient for sequestering the metal ions in the color development bath. For example, they can be added in amounts of from 0.1 gram to 10 grams per liter. Furthermore, optional development accelerators can be added, where required, to the color development bath.

Thus, the thioether based compounds disclosed, for example, in JP-B-37-1608, JP-B-37-5987, JP-B-38-7826, JP-B-44-12380, JP-B-45-9019 and U.S. Pat. No. 3,813,247, the p-phenylenediamine based compounds disclosed in JP-A-52-49829 and JP-A-50-15554, the quaternary ammonium salts disclosed, for example, in JP-A-50-137726, JP-B-44-30074, JP-A-56-156826 and JP-A-52-43429, the p-aminophenols disclosed in U.S. Pat. Nos. 2,610,122 and 4,119,462, the amine based compounds disclosed, for example, in U.S. Pat. Nos. 2,494,903, 3,128,182, 4,230,796 and 3,253,919, JP-B-41-11431, and U.S. Pat. Nos. 2,482,546, 2,596,926 and 3,582,346, the polyalkylene oxides disclosed, for example, in JP-B-37-16088, JP-B-42-25201, U.S. Pat. No. 3,128,183, JP-B-41-11431, JP-B-42-23883 and U.S. Pat. No. 3,532,501, and 1-phenyl-3-pyrazolidones, hydrazines, meso-ionic compounds, ionic compounds and imidazoles, for example, can be added, where required, as development accelerators.

Optional anti-foggants can be added, where required, in the present invention. Alkali metal halides such as potassium bromide and potassium iodide, and organic anti-foggants can be used for this purpose. Typical examples of organic anti-foggants include the nitrogen containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

The inclusion of fluorescent whiteners in the color development baths used in the present invention is desirable. The 4,4'-diamino-2,2'-disulfostilbene based compounds are preferred as fluorescent whiteners and can be added in amounts of from 0 to 5 g/l, and preferably from 0.1 to 4 g/l.

Furthermore, various surfactants, such as alkylsulfonic acids, arylsulfonic acids, aliphatic carboxylic acids and aromatic carboxylic acids for example, may be added, where required.

The color development bath processing temperature in the present invention is from 20° C. to 50° C., and preferably from 30° C. to 40° C.

Iron complexes are included among the bleaching agents in the bleaching baths or bleach-fixing baths which can be used in the present invention. From among these complexes, the aminopolycarboxylic acid iron complexes are preferred, and they are added in amounts of from 0.01 to 1.0 mol/liter, and preferably from 0.05 to 0.50 mol/liter.

Thiosulfate can be used as the fixing agent in the fixer baths and bleach-fixing baths. The use of ammonium thiosulfate is preferred and can be added in an amount of from 0.1 to 5.0 mol/liter, and preferably from 0.5 to 2.0 mol/liter.

Sulfite is generally added t which baths-bleaching, bleach-fixing, fixer as a preservative, but ascorbic acid, carbonylbisulfite addition compounds or carbonyl compounds may be added as well. Moreover, buffers, fluorescent whiteners, chelating agent and fungicides, for example, can also be added to which baths-bleaching, bleach-fixing, fixer where required.

Various compounds can be used as bleaching accelerators in the bleaching baths, bleach-fixing baths and/or bleaching or bleach-fixing pre-baths. For example, the compounds which have a mercapto group or a disulfide group disclosed in U.S. Pat. No. 3,893,858, West German Patent 1,290,812, JP-A-53-95630 and *Research Disclosure,* No. 17129 (July 1978), the thiazolidine derivatives disclosed in JP-A-50-140129, the thiourea derivatives disclosed in U.S. Pat. No. 3,706,561, the iodide disclosed in JP-A-58-16235, the polyethyleneoxides disclosed in West German Patent 2,748,430 and the polyamine compounds disclosed in JP-B-45-8836 can be used for this purpose.

Furthermore, the silver ion concentration in baths which have a fixing ability, such as the bleach-fixing and fixing baths, increases when the rate of bath replenishment is reduced. This increase in silver ion concentration results in an increase in the amount of silver which is carried over into the water washing tank and/or stabilizing tank, which in turn results in an increase in the amount of silver sulfide which is formed in these baths. As discussed above, an increase in the amount of silver sulfide has an adverse effect on the reverse osmosis membrane treatment. Hence, the method of the present invention is preferably applied in cases where the liquid replenishment rate of the baths which have a fixing ability is not more than 100 ml/m$^2$ of photosensitive material with the most preferable 40 to 80 ml/m$^2$.

The photosensitive material to which the invention is applied may be, for example, an ordinary black-and-white silver halide photosensitive material (for example, camera black-and-white sensitive materials, X-ray black-and-white sensitive materials, black-and-white sensitive materials for printing purposes), ordinary multi-layer color photosensitive materials (for example, color negative films, color reversal films, color positive films, color negative films for cinematographic purposes), and sensitive materials for use with infrared light laser scanners.

No particular limitations are imposed upon the type of silver halide used, the method of manufacture, the method of chemical sensitization, the method used for the prevention of fogging, the stabilizers, film hardening agents, antistatic agents, couplers, plasticizers, lubricants, coating promotors, matting agents, whiteners, spectral sensitizers, dyes, ultraviolet absorbers which are used in the silver halide emulsion layers and surface protective layers, for example, or the support of the photosensitive material in the present invention. In this regard, one can refer to the disclosures, for example, in *Product Licensino*, Volume 92, pages 107–110 (Dec., 1971), *Research Disclosure*, No. 17643 (Dec., 1978), *ibid*, No. 18176 (Nov., 1979) and *ibid*, No. 23815 (Feb., 1984).

Color development processing using a color development process is effective for the efficient realization of the present invention and is preferred for the processing in the present invention. Hence, silver halide color photosensitive materials, and especially color paper photosensitive materials in which so-called silver chloride emulsions which have a high silver chloride content are preferably used, are suitable materials for processing in accordance with the present invention. The silver chloride content of these high silver chloride materials is preferably at least 90 mol %, and more desirably at least 95 mol %. The use of more or less pure silver chloride emulsions which have a silver chloride content of from 98 to 99.9 mol % is most preferred with a view to reducing the rate of replenishment of the development processing bath.

The couplers preferably used in the color photosensitive materials in the present invention are described below.

The couplers disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,064, *Research Disclosure*, No. 24220 (June 1984), JP-A-60-33552, *Research Disclosure*, No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and WO(PCT) 88/04795 are especially desirable.

Phenol based couplers and naphthol based couplers are used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Laid Open Patent 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199, and JP-A-61-42658 are preferred.

The colored couplers for correcting the unwanted absorptions of colored dyes disclosed, for example, in section VII-G of *Research Disclosure*, No. 17643 (Dec., 1978), U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181 is desirable.

The couplers disclosed in U.S. Pat. No. 4,366,237, British Patent 2,125,570, European Patent 96,570 and West German Laid Open Patent 3,234,533 are preferred as couplers in which the colored dyes have a suitable degree of diffusibility.

Typical examples of polymerized dye forming couplers have been disclosed, for example, in U.S. Pat. Nos. 3,451,820, 4,080,211, 4,409,320 and 4,576,910, and British Patent 2,102,173.

The use of couplers which release photographically useful residual groups on coupling is preferred in the present invention. The DIR couplers which release development inhibitors disclosed in the patents cited in section VII-F of the *Research Disclosure* 17643 (Dec., 1978), JP-A-57-151944, JP-A-57-154234, JP-A-60-184248, JP-A-63-37346 and U.S. Pat. No. 4,248,962 are preferred.

The couplers disclosed in British Patents 2,097,140 and 2,131,188, JP-A-59-157638 and JP-A-59-170840 are preferred as couplers which release nucleating agents or development accelerators in the form of the image during development.

Other couplers which can be used in photosensitive materials in the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler-releasing couplers, DIR coupler releasing redox compounds or DIR redox-releasing redox compounds disclosed, for example, in JP-A-60-185950 and JP-A-62-24252, the couplers disclosed in European Patent 173,302A, which release dyes which have had their color is restored after elimination, the bleach accelerator-releasing couplers disclosed, for example, in *Research Disclosure* Nos. 11449 (Oct., 1973), and 24241 (June, 1984), and JP-A-61-201247, the ligand-releasing couplers disclosed, for example, in U.S. Pat. No. 4,553,477, the leuco dye-releasing couplers disclosed in JP-A-63-75747, and the couplers disclosed in U.S. Pat. No. 4,774,181, which release fluorescent dyes.

With the present invention, contact of the washing water and/or stabilizing liquid with the air is reduced when the open fraction of the water washing tank and/or stabilizing tank is set to not more than 0.03. This open fraction reduces the oxygen supply and consequently reduces the amount of silver sulfide which is formed, since silver sulfide formation depends on the presence of oxygen. Thus, the reverse osmosis membrane is not liable to become blocked by silver sulfide, and a high water permeating rate can be maintained.

Furthermore, if color development is carried out using a color development bath which does not contain benzyl alcohol in the method of processing of the present invention, there is no propagation of bacteria by benzyl alcohol in the water washing tank and/or stabilizing tank. As a result, there is little blockage of the reverse osmosis membrane by bacterial colonies, and permeated water of poor water quality because of the presence of bacteria is not produced.

The liquid feed pressure in the reverse osmosis membrane treatment is generally from 2 to 30 kg/cm$^2$, but in the present invention a satisfactory permeation rate is obtained with pressures of from 2 to 15 kg/cm$^2$. Pressures preferably of not more than 7 kg/cm$^2$, and more preferably of not more than 5 kg/cm$^2$, are desirable from the viewpoint of reducing the cost of the apparatus, reducing power consumption, reducing noise levels and reducing the amount of heat which is generated Furthermore, the introduction of the permeated liquid from the reverse osmosis membrane treatment to the liquid in a water washing tank and/or a stabilizing tank is preferred from the viewpoint of reducing the dissolved oxygen content in the water washing tank and/or stabilizing tank.

The present invention is described in detail below by means of illustrative examples, but it should be understood that they are not intended to limit the present invention. Unless otherwise indicated, all parts, percents, ratios and the like are by weight.

EXAMPLE 1

The multi-layer color printing paper described below was exposed in a printer and then processed on the basis of the processing operations indicated in Table 2 under the processing conditions described below in the processing apparatus which is shown schematically in the drawing.

In the drawing, 1 is the color development tank (D), 2 is the bleach-fixing tank (BF), and 3, 4, 5 and 6 are the first water washing tank( $W_1$), the second water washing tank ($W_2$), the third water washing tank ($W_3$) and the fourth water washing tank ($W_4$), respectively. Fresh washing water 7 is supplied to the fourth water washing tank ($W_4$), washing water from this tank is fed via the connecting pipe 8 to the third water washing tank ($W_3$) of the previous stage, and ultimately via the sequence of connecting pipes 9 and 10 to the first water washing tank ($W_1$), thereby providing a multistage counter-flow system. Overflow water from the first water washing tank ($W_1$) was removed via the overflow stream 11. Each water washing tank measured 10 cm×20 cm×20 cm deep.

Washing water was taken out via the connecting pipe 12 from the third water washing tank ($W_3$) and fed by the pump (P) 13 to the reverse osmosis membrane module (RO) 14. This process was operated at a reverse liquid pressure of 3.5 kg/cm$^2$ and a reverse flow rate of 2 l/min. The permeated water was fed to the fourth water washing tank ($W_4$) via the connecting pipe 15 and the concentrated water was returned to the third water washing tank ($W_3$) via the connecting pipe 16. A spiral type RO module element DRA-80 (effective surface area 1.1 m$^2$, polysulfone based composite membrane) made by Daicel Kagaku Co. was used for the reverse osmosis membrane in the reverse osmosis membrane module (RO) 14 and was housed in a plastic pressure resistant vessel model PV-0321 made by the same company.

The color developer, bleach-fixer and washing water having the respective compositions described hereinafter were supplied to the color development tank (D) 1, the bleach-fixing tank (BF) 2 and the first to the fourth water washing tanks ($W_1$–$W_4$) of the processing apparatus.

The processing operations in the processing apparatus were as shown in Table 2.

TABLE 2

| | | Processing Operations | | |
|---|---|---|---|---|
| Process | Temperature | Processing Time | Tank Capacity | Replenishment Rate |
| Color Developing | 38.5° C. | 45 seconds | 8 liters | 70 ml/m$^2$ |
| Bleach-fixing | 38.0° C. | 45 seconds | 8 liters | 60 ml/m$^2$ |
| Water Washing 1 | 38.0° C. | 15 seconds | 4 liters | |
| Water Washing 2 | 38.0° C. | 15 seconds | 4 liters | four stage |
| Water Washing 3 | 38.0° C. | 15 seconds | 4 liters | counter-flow |
| Water Washing 4 | 38.0° C. | 15 seconds | 4 liters | 160 ml/m$^2$ |
| Drying | 75° C. | 50 seconds | | |

The exposed multi-layer color printing paper was processed at the rate of 30 meter per day for 30 days while tempering and circulating the processing liquids for 10 hours per day in the processing apparatus.

Floating lids made of poly(vinyl chloride) of varying area were fitted to the water washing tanks, (which had an open fraction of 0.05 when no floating lid was present), and the open area of the water washing tanks was varied (S/V was also varied proportionately). The average flow rate of the permeated water and the EDTA·Fe content of the permeated water (shown as Fe) were measured after running for 20 days.

Furthermore, the printing paper which had been processed after running for 30 days was stored for 5 days under conditions of 80° C. and 70% RH, and the changes which occurred in yellow staining were observed during this time.

The results of these measurements are shown in Table 3.

-continued

| | Mother Liquid | Replenisher |
|---|---|---|
| Fluorescent whitener (4,4'-diaminostilbene based) | 1.2 grams | 2.0 grams |
| Benzyl alcohol | See Table 3 | See Table 3 |
| Diethyleneglycol | See Table 3 | See Table 3 |
| Water to make up to | 1000 ml | 1000 ml |
| pH, with potassium hydroxide | 10.05 | 10.20 |
| Bleach-Fixer | | |
| Water | 700 ml | 700 ml |
| Ammonium thiosulfate solution (700 g/l) | 100 ml | 150 ml |

TABLE 3

| No. | Type | Benzyl Alcohol / Diethyleneglycol | | Open Fraction Tank 1 | Tank 2 | Tank 3 | Tank 4 | Average permeation Flow Rate (ml/min) | Average Fe Conc. (mg/l) | Change in Yellow Staining (5 days, 80° C., 70% RH |
|---|---|---|---|---|---|---|---|---|---|---|
| 1 | Comp. Ex. | Mother Liquid 12 gr. / 5 gr. | Replenish 15 gr. / 7 gr. | 0.05 | 0.05 | 0.05 | 0.05 | 35 | 3.5 | 0.163 |
| 2 | Invention | As above | | 0.0125 | 0.0125 | 0.0125 | 0.0125 | 140 | 17.2 | 0.146 |
| 3 | Comp. Ex. | Not Used | | 0.05 | 0.05 | 0.05 | 0.05 | 40 | 1.9 | 0.155 |
| 4 | Invention | Not Used | | 0.05 | 0.05 | 0.0125 | 0.05 | 130 | 1.8 | 0.067 |
| 5 | Invention | Not Used | | 0.05 | 0.0125 | 0.0125 | 0.05 | 147 | 2.0 | 0.057 |
| 6 | Invention | Not Used | | 0.025 | 0.025 | 0.025 | 0.05 | 125 | 1.7 | 0.070 |
| 7 | Invention | Not Used | | 0.0125 | 0.0125 | 0.0125 | 0.0125 | 162 | 1.7 | 0.051 |

Moreover, the above mentioned benzyl alcohol in the Table signifies those used in the color development bath.

Diethyleneglycol was added to the color development bath along with the addition of benzyl alcohol.

According to Table 3, when, with the present invention, the open fraction of the water washing tank is set to not more than 0.03 as shown by No. 2, the average rate of permeation of water can be maintained at a high level even when a color developer which contains benzyl alcohol is being used. Furthermore, in those cases where a color developer which does not contain benzyl alcohol is used, as well as maintaining a high average water permeation rate, the average Fe concentration of the permeated water is reduced and yellow staining is suppressed to a low level.

The compositions of the color developer etc. used in this example are indicated below.

| | Mother Liquid | Replenisher |
|---|---|---|
| Color Developer | | |
| Ethylenediamine-N,N,N',N'-tetramethylenephosphonic acid | 2.5 grams | 4.5 grams |
| Triethanolamine | 5.0 grams | 11.0 grams |
| Sodium chloride | 3.5 grams | — |
| Potassium bromide | 0.02 gram | — |
| Diethylhydroxylamine | 4.0 grams | 10.0 grams |
| N-Ethyl-N-(β-ethanesulfonamidoethyl)-3-methyl-4-aminoaniline sulfate | 5.5 grams | 11.0 grams |
| Potassium carbonate | 25.0 grams | 26.0 grams |
| (700 g/l) | | |
| Ammonium sulfite | 18 grams | 30 grams |
| Ethylenediamine tetra-acetic acid, ferric ammonium salt, di-hydrate | 55 grams | 80 grams |
| Ethylenediamine tetra-acetic acid, di-sodium salt di-hydrate | 3 grams | 5 grams |
| Ammonium bromide | 40 grams | 60 grams |
| Glacial acetic acid | 8 grams | 16 grams |
| Water to make up to | 1000 ml | 1000 ml |
| pH (25° C.) | 5.5 | 4.3 |

Washing Water (Mother Liquid=Replenisher)

Town water (containing 23 mg/l of calcium and 3 mg/l of magnesium, electrical conductivity 170 μs/cm)

Multi-layer Color Printing Paper

The multi-layer color printing paper having the layer structure described below was prepared on a paper support which had been laminated on both sides with polyethylene. The coating liquids were prepared by mixing and dissolving the emulsions, various reagents and emulsified coupler dispersions. The methods of preparation are 1 described in detail below.

Preparation of the Coupler Emulsion: Ethyl acetate (27.2 cc) and 7.7 cc of solvent (Solv-1) were added to 19.1 grams of yellow coupler (ExY) and 4.4 grams of color image stabilizer (Cpd-1), and a solution was formed. This solution was emulsified and dispersed in 185 cc of a 10% aqueous gelatin solution which contained 8 cc of 10% sodium dodecylbenzenesulfonate.

The magenta, cyan and intermediate layer emulsions below were prepared in the same way. The compounds used in each emulsion are indicated below.

(ExY) Yellow Coupler

-continued
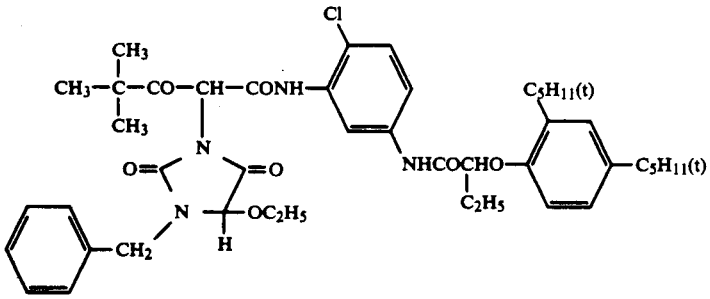
(ExM1) Magenta Coupler
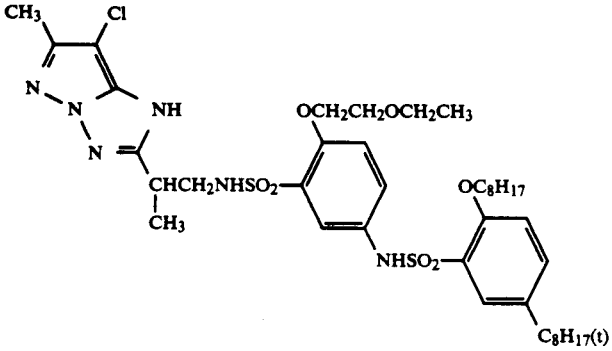
(ExC1) Cyan Coupler
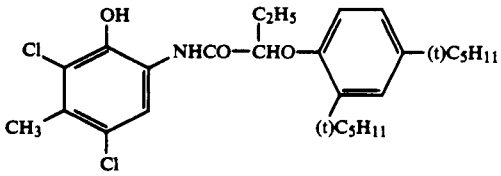
(ExC2) Cyan Coupler
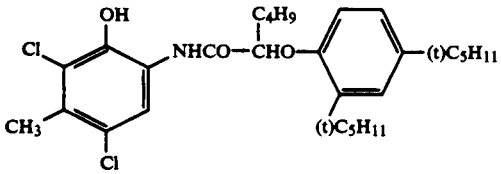
(ExC3) Cyan Coupler
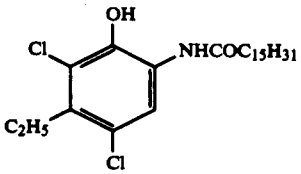
(Cpd-1) Color Image Stabilizer
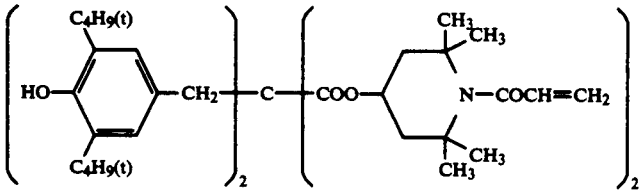
(Cpd-2) Anti-color Mixing Agent -continued
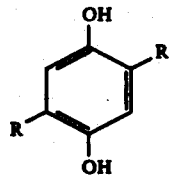
R = $C_8H_{17}$(sec)
Cpd-3 Color Image Stabilizer
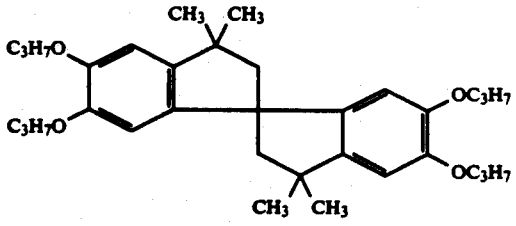
Cpd-4 Color Image Stabilizer
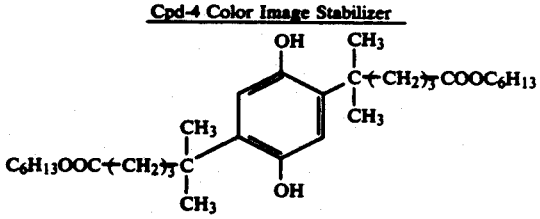
(Cpd-5) Anti-color Mixing Agent
Same as Cpd-2 but R = $C_8H_{17}$(t)
(Cpd-6) Colored Image Stabilizer
A 5:8:9 (by weight) mixture of 6a:6b:6c
6a
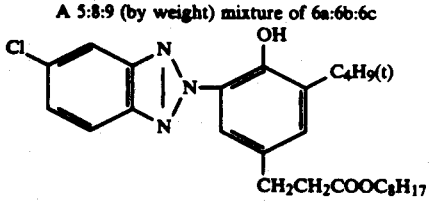
6b
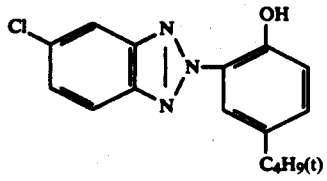
6c
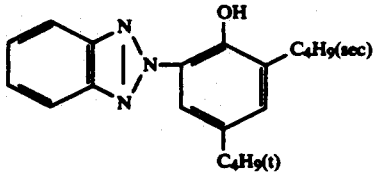
(Cpd-7) Polymer
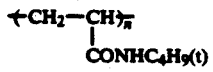
Number Average Molecular Weight 80,000
(UV-1) Ultraviolet Absorber
A 2:9:8 (by weight) mixture of Cpd 6a:6b:6c
(Solv-1) Solvent
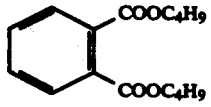

-continued (Solv-2) Solvent $O{=}P{-}(O{-}C_8H_{17}(iso))_3$ (Solv-3) Solvent $O{=}P{-}(O{-}C_9H_{19}(iso))_3$ (Solv-4) Solvent

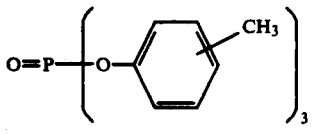

The dyes indicated below were added in amount of 15 mg/m$^2$ each for anti-irradiation purposes. Red Layer: Dye-R

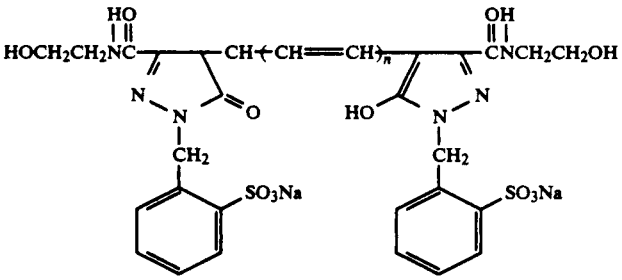

Where n = 2 Green Layer: Same as Dye-R but with n = 1.

The compound indicated below was added at the rate of $2.6\times10^{-3}$ mol per mol of silver halide to the red sensitive emulsion layer.

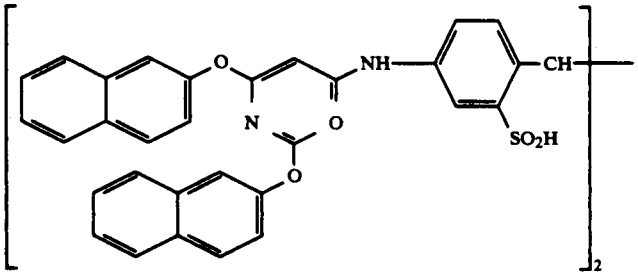

The emulsions used in this example are described below.

Blue Sensitive Emulsion: A mono-disperse cubic silver chloride emulsion containing grains having an average size of 1.1 μm and a variation coefficient (the value s/d obtained by dividing the standard deviation by the average grain size) of 0.10 and containing $K_2IrCl_6$ and 1,3-dimethylimidazolin-2-thione was prepared in the usual way. Next, 26 cc of a 6% solution of the blue spectral sensitizing dye (S-1) was added to 1 kg of this emulsion, and a silver romide fine grain emulsion having a grain size of 0.05 μm was added in the amount of 5 mol % with respect to the host silver chloride emulsion. After ripening, sodium thiosulfate was added, and the mixture was chemically sensitized optimally. Then, $10^{-4}$ mol/mol·Ag of stabilizer (Stb-1) was added and the emulsion was obtained.

Green Sensitive Emulsion: A mono-disperse cubic silver chloride emulsion containing grains having an average grain size of 0.48 μm and a variation coefficient 0.10 was prepared by preparing silver chloride grains which contained $K_2IrCl_6$ and 1,3-dimethylimidazolin-2-thione in the usual way, for example, a manner disclosed in JP-A-2-100049, Example 1, and then adding $4\times10^{-4}$ mol/mol·Ag of sensitizing dye (S-2) and KBr. After ripening, sodium thiosulfate was added, and chemical sensitization was carried out optimally. Then $5\times10^{-4}$ mol/mol·Ag of stabilizer (Stb-1) was added to obtain the emulsion.

Red Sensitive Emulsion: This emulsion was prepared in the same way as the green sensitive emulsion. However, the sensitizing dye (S-3) was used at a rate of $1.5\times10^{-4}$ mol/mol·Ag instead of S-2.

The compounds used are indicated below.

(S-1) Sensitizing Dye

-continued

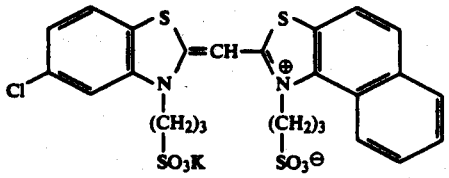

(S-2) Sensitizing Dye

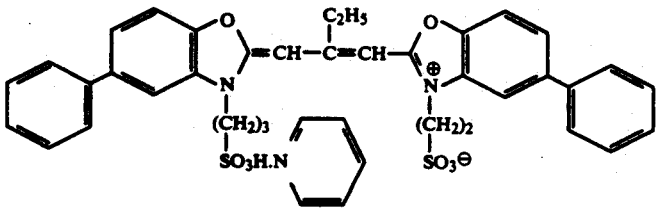

(S-3) Sensitizing Dye

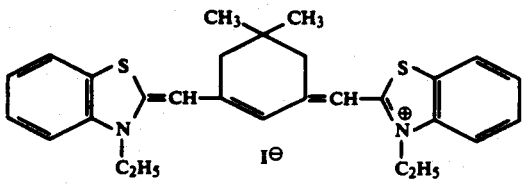

(Stb-1) Stabilizer

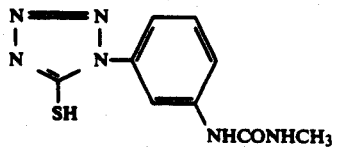

Layer Structure

The composition of each layer in the sample is indicated below. The numerical value indicates the coated weight (g/m$^2$). The coated weights of silver halide emulsions are shown after calculation as silver.

Support

Polyethylene laminated paper. (White pigment ($TiO_2$) and blue dye (ultramarine) were included in the polyethylene on the first layer side)

| | |
|---|---|
| First Layer (Blue Sensitive Layer) | |
| Silver halide emulsion | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Second Layer (Anti-color Mixing Layer) | |
| Gelatin | 0.99 |
| Anti-color mixing agent (Cpd-2) | 0.08 |
| Third Layer (Green Sensitive Layer) | |
| Silver halide emulsion | 0.36 |
| Gelatin | 1.24 |
| Magenta coupler (ExM1) | 0.31 |
| Color image stabilizer (Cpd-3) | 0.25 |
| Color image stabilizer (Cpd-4) | 0.12 |
| Solvent (Solv-2) | 0.42 |
| Fourth Layer (Ultraviolet Absorbing Layer) | |
| Gelatin | 1.58 |
| Ultraviolet absorber (UV-1) | 0.62 |
| Anti-color mixing agent (Cpd-5) | 0.05 |
| Solvent (Solv-3) | 0.24 |
| Fifth Layer (Red Sensitive Layer) | |
| Silver halide emulsion | 0.23 |
| Gelatin | 1.34 |

-continued

| | |
|---|---|
| Cyan coupler (1:2:2 blend of ExC1:ExC2:ExC3) | 0.34 |
| Color image stabilizer (Cpd-6) | 0.17 |
| Polymer (Cpd-7) | 0.40 |
| Solvent (Solv-4) | 0.23 |
| Sixth Layer (Ultraviolet Absorbing Layer) | |
| Gelatin | 0.53 |
| Ultraviolet absorber (UV-1) | 0.21 |
| Solvent (Solv-3) | 0.08 |
| Seventh Layer (Protective Layer) | |
| Gelatin | 1.33 |
| Poly(vinyl alcohol) acrylic modified copolymer (17% Modification) | 0.17 |
| Liquid paraffin | 0.03 |

1-Oxy-3,5-dichloro-s-triazine, sodium salt, was used in each layer as a film hardening agent.

The color printing paper prepared in the way described above was cut to a width of 82.5 mm.

EXAMPLE 2

A printing paper, Fujicolor Super FA which is a color paper for rapid processing and comprises high silver chloride emulsion, (width 117 mm), made by the Fuji Photo Film Co., Ltd. was exposed in a printer and processed using the process B, which is shown in Table 4.

Furthermore, a color printing paper, Fujicolor Super HG which is a color paper comprising silver chlorobromide emulsion (width 117 mm), made by the same company, was also exposed in the same way and processed using process A, which is shown in Table 4.

TABLE 4

| | Processing Method A | | | | Processing Method B | | | |
|---|---|---|---|---|---|---|---|---|
| | Time | Temperature | Replenishment Rate (ml/m²) | Capacity (l) | Time | Temperature | Replenishment Rate (ml/m²) | Capacity (l) |
| Color Development | 100 sec | 38.0° C. | 280 | 8 | 45 sec | 38.0° C. | 61 | 17 |
| Bleach-fixing | 60 sec | 35.0° C. | 60 | 8 | 45 sec | 35.0° C. | 61 | 10 |
| Water Washing 1 | 15 sec | 35.0° C. | | 4 | 20 sec | 35.0° C. | | 4 |
| Water Washing 2 | 15 sec | 35.0° C. | | 4 | 20 sec | 35.0° C. | | 4 |
| Water Washing 3 | 15 sec | 35.0° C. | | 4 | 20 sec | 35.0° C. | | 4 |
| Water Washing 4 | 15 sec | 35.0° C. | 60 | 4 | 30 sec | 35.0° C. | 61 | 4 |
| Drying | 50 sec | 75° C. | | 4 | 60 sec | 75° C. | | |

A color developer having the composition described hereinafter was used for color development in these processing methods. The bleach-fixing bath and the washing water were the same as in Example 1.

The processing was carried out in the same processing apparatus as shown in FIG. 1, but the overflow from the first water washing tank was introduced into the bleach-fixing tank. The reverse osmosis membrane module (RO) was fitted to the third water washing tank. Processing was carried out under conditions such that the open fraction of each water washing tank was 0.015 $cm^{-1}$, the flow rate of washing water to the reverse osmosis module was 1500 ml/min, the permeated water flow rate was 150 ml/min and the concentrated water flow rate was 1350 ml/min.

This process was operated at reverse liquid pressure of 3.5 kg/cm².

The processing liquids were circulated and tempered for 12 hours per day under the conditions indicated above and 60 m of the aforementioned printing paper was processed each day during this period. This procedure was maintained for 8 weeks (5 days per week).

The average water permeation rate for the 8 weeks, the EDTA-Fe content of the permeated water as Fe, and the silver thiosulfate complex content as silver were measured. The results obtained are shown in Table 5.

The increase in average yellow staining from the first week to the last week is also shown in Table 5.

TABLE 5

| | | Average Water Permeation Rate (ml/mn) | Fe (Mg/l) | Ag (Mg/l) | Change (Increase) Yellow Staining* |
|---|---|---|---|---|---|
| Invention | Process A | 120 | 21.2 | 26.0 | 0.042 |
| Invention | Process B | 136 | 2.3 | 4.3 | 0.016 |

*The yellow staining change shows a variation of the yellow reflaction density obtained by X-rite 310 type, Photographic Densito Meter.

| Color Development Bath | Process A Mother Liquid | Process A Replenisher | Process B Mother Liquid | Process B Replenisher |
|---|---|---|---|---|
| Diethylenetriamine penta-acetic acid | 1.0 gram | 1.2 grams | — | — |
| Nitrilo-N,N,N-trimethylenephosphonic acid | 2.0 grams | 2.4 grams | — | — |
| 1-Hydroxyethylidene-1,1-diphosphonic acid | 1.0 gram | 1.2 grams | | |
| Benzyl alcohol | 15 ml | 23 ml | — | — |
| Diethyleneglycol | 10 ml | 10 ml | — | — |
| Sodium sulfite | 1.5 grams | 2.0 grams | 0.02 gram | 0.02 gram |
| Potassium bromide | 0.6 gram | — | 0.015 gram | — |
| Hydroxylamine sulfate | 2.5 grams | 3.5 grams | — | — |
| Hydrazinodiacetic acid | — | — | 5.0 grams | 12.0 grams |
| Ethylenediamine-N,N,N',N'-tetramethylene-phosphonic acid | — | — | 2.5 grams | 5.0 grams |
| Triethanolamine | — | — | 5.0 grams | 11.0 grams |
| Sodium chloride | — | — | 3.5 grams | — |
| Potassium carbonate | 25.0 grams | 26.0 grams | 25.0 grams | 27.0 grams |
| Fluorescent whitener (4,4'-diaminostilbene based) | 1.2 grams | 1.5 grams | 1.2 grams | 2.5 grams |
| N-Ethyl-N-(β-methanesulfonamidoethyl)-3-methyl-4-aminoaniline sulfate | 5.0 grams | 7.0 grams | 5.5 grams | 10.5 grams |
| Potassium hydroxide added to pH | 10.20 | 10.40 | 10.05 | 10.25 |
| Water to make up to | 1 liter | 1 liter | 1 liter | 1 liter |

EXAMPLE 3

The same processing apparatus as used in Example 1 was used except that stabilizing tanks were employed instead of the water washing tanks and the stabilizer bath described below was used instead of the washing water. Hence, the stabilization process was a multi-stage counter-flow system. Otherwise, the multi-layer color printing paper and the processing conditions were the same as in Example 1, and the aforementioned printing paper was processed.

| Stabilizer Bath Mother Liquid = Replenisher | |
|---|---|
| 1-Hydroxyethylidene-1,1-diphosphonic acid | 1.4 grams |
| Nitrilo-N,N,N-trimethylenephosphonic acid | 3.0 grams |
| 5-Chloro-2-methyl-4-isothiazolin-3-one | 0.3 gram |
| Ammonium chloride | 0.3 gram |
| Fluorescent whitener (4,4-diaminostilbene based) | 0.1 gram |
| With aqueous ammonia and hydrochloric acid, pH | 6.7 |
| Water to make up to | 1 liter |

The results obtained were the same as those in Example 1.

With the present invention, membrane blockage in the reverse osmosis membrane treatment which is associated with a water washing tank and/or stabilizing tank in the processing of silver halide color photosensitive materials can be reduced, and the permeation rate of the membrane can be maintained at a high level. Consequently, it is possible to reduce the amount of washing water and/or stabilizer bath which is used.

Moreover, permeated water and/or permeated liquid which has good water quality is obtained in the reverse osmosis membrane treatment if no benzyl alcohol is used in processing, and the change in yellow staining of printing papers which have been processed in this way is slight.

While the invention has been described in detail and with reference to specific embodiments thereof, it will be apparent to one skilled in the art that various changes and modifications can be made therein without departing from the spirit and scope thereof.

What is claimed is:

1. A method for processing silver halide photosensitive materials comprising processing an imagewise-exposed silver halide photosensitive material in a bath which has a fixing ability and then at least one of washing and stabilizing the photosensitive material in a multi-stage counter-flow system, wherein liquid from at least one of a water washing tank and a stabilizing tank is treated using a reverse osmosis membrane and the treated liquid is recycled to at least one of the water washing tank and stabilizing tank, and at least a tank at the stage at which the liquid is removed for the reverse osmosis membrane treatment has an open fraction of not more than 0.03.

2. A method for processing silver halide photosensitive materials as in claim 1, wherein the multi-stage counter-flow system consists of four washing tanks or stabilization tanks, and the liquid for the reverse osmosis membrane treatment is removed from the third tank in the direction of material processing and the liquid which has been subjected to reverse osmosis is supplied to the fourth tank in the direction of material processing.

3. A method for processing silver halide photosensitive materials as in claim 1, wherein the open fraction is not more than 0.02.

4. A method for processing silver halide photosensitive materials as in claim 3, wherein the open fraction is not more than 0.01.

5. A method for processing silver halide photosensitive materials as in claim 1, wherein the bath which has a fixing ability is replenished at a rate of not more than 100 ml/m$^2$ of photosensitive material.

6. A method for processing silver halide photosensitive materials as in claim 1, wherein the reverse osmosis membrane treatment uses a liquid feed pressure of from 2 to 15 kg/cm$^2$.

7. A method for processing silver halide photosensitive materials as in claim 6, wherein the liquid feed pressure is from 2 to 7 kg/cm$^2$.

8. A method for processing silver halide photosensitive materials as in claim 7, wherein the liquid feed pressure is from 2 to 5 kg/cm$^2$.

9. A method for processing silver halide color photosensitive material as in claim 1, wherein the water washing bath or stabilizing bath is replenished at a rate of not more than 200 ml/m$^2$.

10. A method for processing silver halide color photosensitive materials comprising color developing an imagewise-exposed silver halide color photosensitive material, then processing the photosensitive material in a bath which has a fixing ability, and then water washing/and or stabilizing the photosensitive material in a multi-stage counter-flow system wherein the color developing is carried out with a color development bath which does not contain benzyl alcohol, liquid from at least one of a water washing tank and stabilizing tank is treated using a reverse osmosis membrane and the treated liquid is recycled to at least one of the water washing tank and the stabilizing tank, and at least a tank at the stage at which the liquid is taken out for the reverse osmosis membrane treatment has an open fraction of not more than 0.03.

11. A method for processing silver halide color photosensitive materials as in claim 10, wherein the multi-stage counter-flow system consists of four washing tanks or stabilization tanks, and the liquid for the reverse osmosis membrane treatment is removed from the third tank in the direction of material processing and the liquid which has been subjected to reverse osmosis is supplied to the fourth tank in the direction of material processing.

12. A method for processing silver halide color photosensitive materials as in claim 10, wherein the open fraction is not more than 0.02.

13. A method for processing silver halide color photosensitive materials as in claim 12, wherein the open fraction is not more than 0.01.

14. A method for processing silver halide color photosensitive materials as in claim 10, wherein the bath which has a fixing ability is replenished at a rate of not more than 100 ml/m$^2$ of photosensitive material 15. A method for processing silver halide color photosensitive materials as in claim 10, wherein the photosensitive materials comprise silver halide having a silver chloride content of at least 90 mol %.

16. A method for processing silver halide color photosensitive materials as in claim 15, wherein the silver chloride content is at least 95 mol%.

17. A method for processing silver halide color photosensitive materials as in claim 16, wherein the silver chloride content is from 98 to 99.9 mol %.

18. A method for processing silver halide color photosensitive materials as in claim 10, wherein the reverse osmosis membrane treatment uses a liquid feed pressure of from 2 to 15 kg/cm$^2$.

19. A method for processing silver halide color photosensitive materials as in claim 18, wherein the liquid feed pressure is from 2 to 7 kg/cm$^2$.

20. A method for processing silver halide color photosensitive materials as in claim 19, wherein the liquid feed pressure is from 2 to 5 kg/cm$^2$.

* * * * *